United States Patent [19]

Iten

[11] Patent Number: 4,996,772

[45] Date of Patent: Mar. 5, 1991

[54] SHIELD FOR SAFETY RAZOR WITH LUBRICATION STRIP

[75] Inventor: Clemens A. Iten, Fisherville, Va.

[73] Assignee: American Safety Razor Company, Verona, Va.

[21] Appl. No.: 390,925

[22] Filed: Aug. 8, 1989

[51] Int. Cl.[5] ..... B26B 19/44

[52] U.S. Cl. ..... 30/41; 30/41.5; 30/84; 30/123.3

[58] Field of Search ..... 30/41, 41.5, 74.1, 84, 30/123.3

[56] References Cited

U.S. PATENT DOCUMENTS

| | | | |
|---|---|---|---|
| 4,170,821 | 10/1979 | Booth | 30/41 |
| 4,709,476 | 12/1987 | Shurtleff et al. | 30/41 |
| 4,850,107 | 7/1989 | Valliades et al. | 30/41 |

FOREIGN PATENT DOCUMENTS 0320847 6/1989 European Pat. Off. .

*Primary Examiner*—Paul A. Bell
*Assistant Examiner*—Willmon Fridie, Jr.
*Attorney, Agent, or Firm*—Nixon & Vanderhye

[57] ABSTRACT

A shield overlies a razor head having a lubrication strip disposed behind the cutting edges of the blades disposed on the head. The shield is spaced from the head to facilitate drying the strip and hence reduce swelling or enlargement of the lubrication strip due to moisture absorption following shaving. The shield also has a plurality of openings through its base to facilitate circulation of air in the space between the shield and the head whereby drying of the lubrication strip and, hence, reduction of its enlargement are further accomplished.

6 Claims, 4 Drawing Sheets

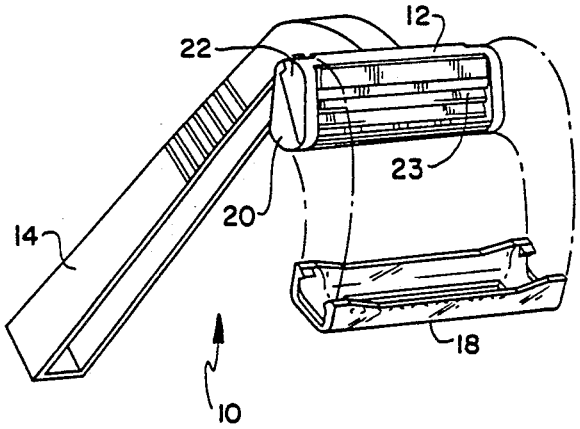
FIG. 1
FIG. 2
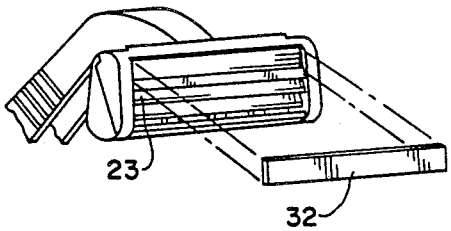
FIG. 3
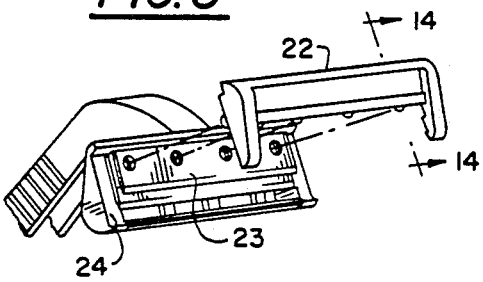
FIG. 4
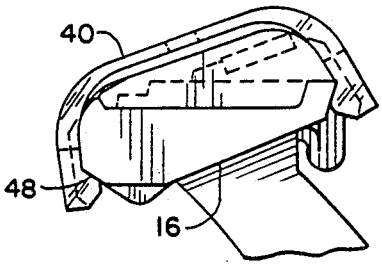
FIG. 5
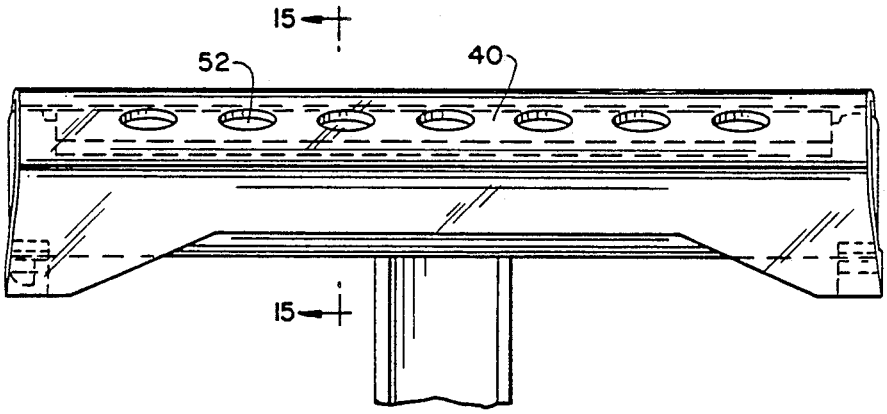

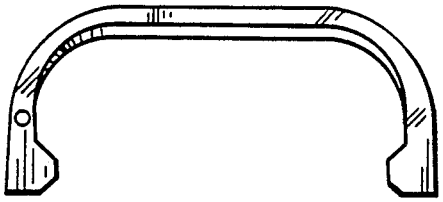
FIG. 8
FIG. 13
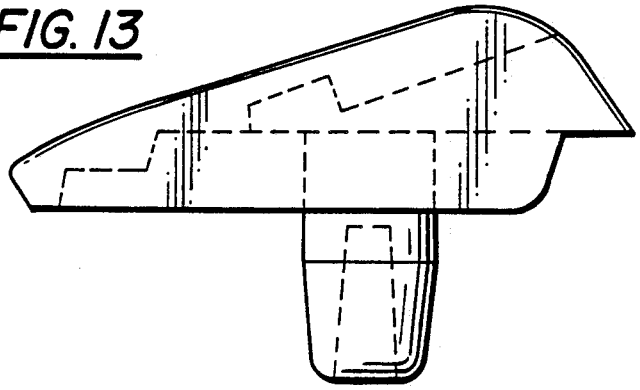
FIG. 14
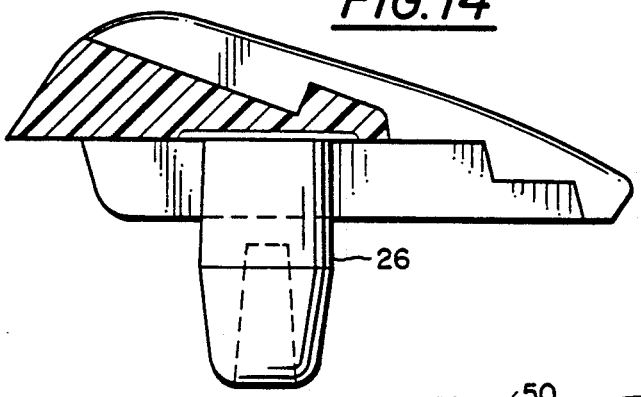
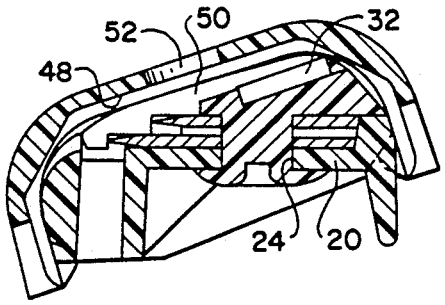
FIG. 15

SHIELD FOR SAFETY RAZOR WITH LUBRICATION STRIP

BACKGROUND AND SUMMARY OF THE INVENTION

The present invention relates to safety razors and particularly relates to a shield and safety razor assemblage which affords clearance between the shield and the lubrication strip to permit ingress of air and drying of the lubrication strip.

Safety razors are commonly formed of a handle secured at one end to a razor head comprised of a subassembly of a platform and a cap member for retaining the razor blades in assembly. The razor is also provided with a shield to protect the user from injury resulting from inadvertent contact with the blade edge and to protect the blade edge from damage during shipping, handling, etc. A razor of this type is described and illustrated in U.S. Pat. No. 4,833,779, issued May 30, 1989.

It has become desirable to provide the razor head with a lubrication strip to facilitate the shaving action. The lubrication strip may be formed of a polyethyelene oxide and polystyrene. The strip is located behind the cutting edge of the blade or blades on the razor head and smooths the passage of the razor head over the skin.

In this type of razor, however, it has been found that the lubrication strip absorbs moisture and swells during use. Daily use without giving the strip a chance to dry causes problems. The strip becomes viscous and loses durability and definition. If the strip remains swollen from moisture absorption, locating the shield on the razor makes the strip conform to the inside contour of the shield. The strip material will also tend to adhere to the shield as the latter is removed, causing the strip to string out. Additionally, the detenting locking action of the shield onto the razor head, as described and illustrated in the above-identified patent, frequently cannot be accomplished because of the interference caused by the swelled lubrication strip with the shield. Further, the swollen lubrication strip can pop the shield off the razor head even after the shield has been applied thereto. It has therefore been found necessary to provide a razor construction which accommodates this type of reaction of the lubrication strip to shaving, while simultaneously affording all of the advantages of the safety razor and shield combination as set forth in the above-listed patent.

Therefore, in one aspect of the present invention, there is provided a lubrication strip on the platform of the razor head directly behind the cutting edge of the blade or blades. The strip is disposed longitudinally parallel to the razor blades in a recess formed in the platform such that the upper surface of the lubrication strip is substantially in-line with the cutting edge of the blade or blades and raised slightly above the upper surface of the platform. To facilitate drying of the lubrication strip due to absorption of moisture after use of the razor, according to the present invention, there is provided an enlarged air space between the underside of the shield and the top of the platform, including the lubrication strip. In accordance with a preferred embodiment of the present invention, the shield is undercut or recessed along its underside to provide a substantial clearance between the lubrication strip and the underside of the shield, thereby providing a substantial air space therebetween. The air space provides sufficient space to facilitate and enhance drying of the lubrication strip to minimize swelling and expansion thereof without substantially engaging or applying pressure to the cap or interfering with the fit of the shield on the safety razor head.

Additionally, in accordance with another aspect of the present invention, there is provided one or more through-holes in the base of the generally channel-shaped shield. This affords air communication through the shield into the air space overlying the lubrication strip. The circulation of air into this air space further facilitates drying of the lubrication strip after use and, hence, reduces the swelling or enlargement of the lubrication strip.

In a preferred embodiment according to the present invention, there is provided a razor comprising a handle and an elongated razor head carried by the handle. A razor blade is carried by the head and has a longitudinally extending cutting edge, with an elongated lubrication strip on the razor head adjacent the cutting edge for lubricating the skin during shaving. An elongated shield is removably carried by the head for overlying the cutting edge and the lubrication strip when the razor is not in use. Means are provided for releasably securing the shield and the head one to the other, with the shield being spaced from the lube strip when secured to the head to define an air space between the strip and the shield, with additional means for communicating air into the space into contact with the lubrication strip to facilitate drying of the lubrication strip after shaving and return of the shield to its secured position on the head.

Accordingly, it is a primary object of the present invention to provide a novel and improved safety razor construction having a lubrication strip and a shield for the razor head whereby interference between the lubrication strip and the shield upon swelling of the strip is minimized or eliminated and air movement into the area between the shield and the razor head is facilitated to assist in drying and, hence, reducing the size of the lubrication strip.

These and further objects and advantages of the present invention will become more apparent upon reference to the following specification, appended claims and drawings.

BRIEF DESCRIPTION OF THE DRAWING FIGURES

FIG. 1 is a perspective view of a safety razor and shield constructed in accordance with the present invention and illustrating the shield in a detached position;

FIG. 2 is a view similar to FIG. 1 without the shield and illustrating the attachment of the lubrication strip to the razor head;

FIG. 3 is a view similar to FIG. 1 illustrating the specific construction of the razor head;

FIG. 4 is an enlarged fragmentary end view of the razor head with shield applied;

FIG. 5 is an enlarged front elevational view of the razor head with shield applied;

FIG. 8 is an end elevational view of the shield illustrated in FIG. 6;

FIG. 13 is an enlarged end view of the cap member; and

Figure 6:
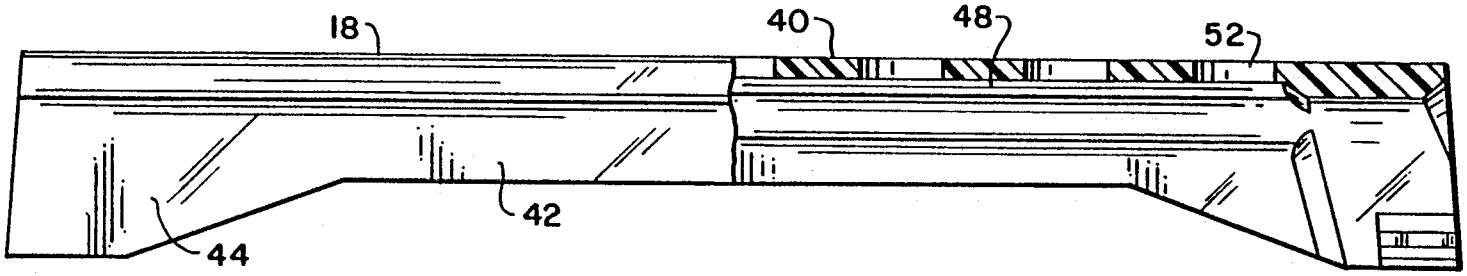
FIG. 6 is an enlarged front elevational view of the shield with parts broken out and in cross-section to illustrate certain features of the present invention.
Figure 7:
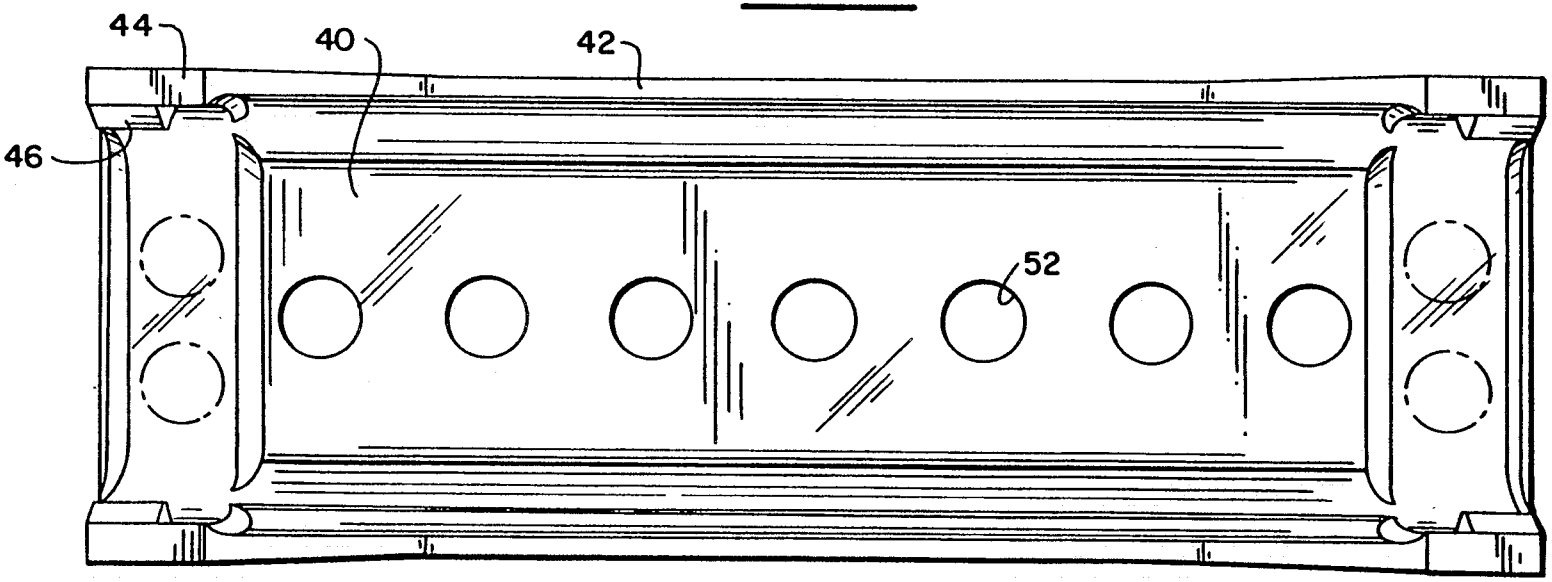
FIG. 7 is a bottom plan view of the shield illustrated in FIG. 6.
Figure 9:
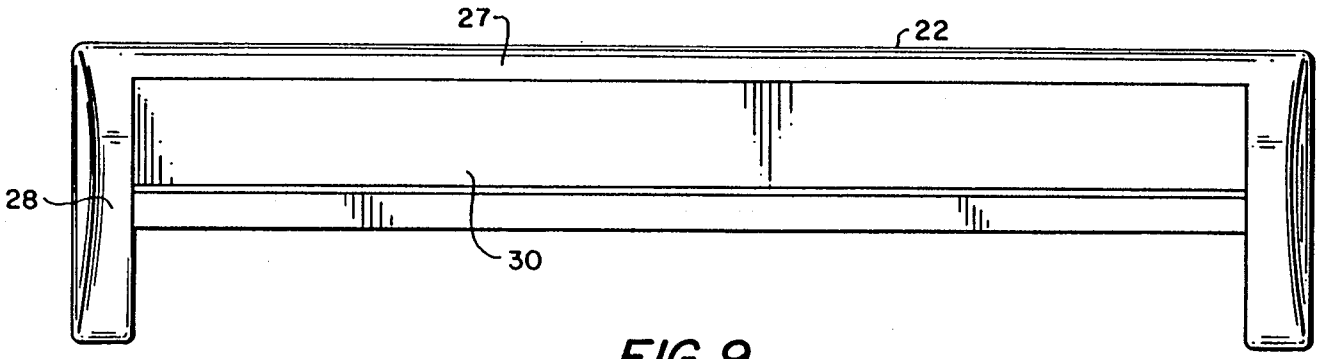
FIG. 9 is a top plan view of the cap member of the razor head.

FIGS. 14 and 15 are enlarged cross-sectional views taken generally about on lines 14—14 and 15—15 in FIGS. 3 and 5, respectively.

DETAILED DESCRIPTION OF THE DRAWING FIGURES

Reference will now be made in detail to the present preferred embodiment of the invention, an example of which is illustrated in the accompanying drawings.

Referring now to the drawings, particularly to FIG. 1, there is illustrated a safety razor, generally designated 10, having a razor blade head 12, a handle 14 carrying a handle head 16 (FIG. 4) at one end and a shield 18 for overlying the razor blade head 12. Razor blade head 12 includes a platform 20 and a cap 22 between which are located one or more blades 23. The cap 22 and the blades 23 form no part of the present invention and further description thereof is believed unnecessary, except to note that openings 24 (FIG. 15) are formed in platform 20 to receive stakes 26 formed along the underside of the cap 22 for securing the cap and platform one to the other and the blades 23 in proper position between the cap and platform. The platform is, of course, suitably attached to the handle 14 and such attachment may be effected by the structure described and illustrated in U.S. Pat. No. 4,833,779, issued May 30, 1989, of common assignee herewith, the disclosure of which is incorporated herein by reference.

Figure 11:
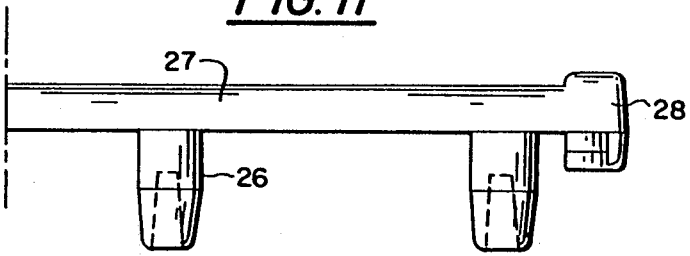
FIG. 11 is a rear elevational view of the cap member illustrated in FIG. 9.
Figure 10:
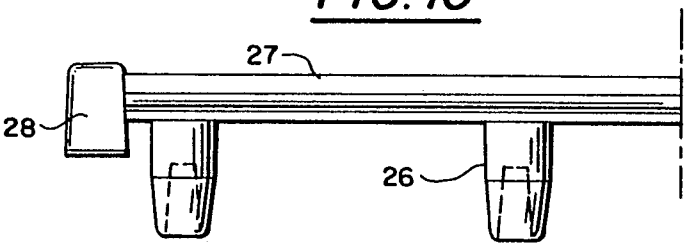
FIG. 10 is a fragmentary front elevational view of the cap member illustrated in FIG. 9.
Figure 12:
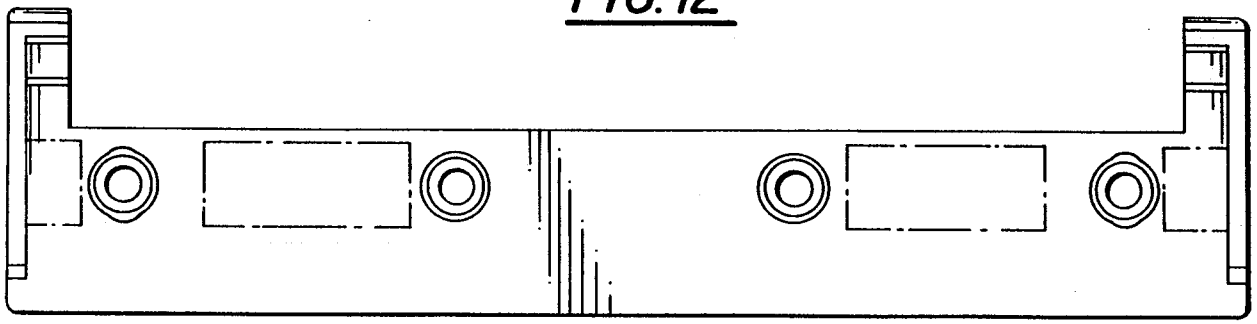
FIG. 12 is a bottom plan view of the cap member illustrated in FIG. 9.

Referring now particularly to FIGS. 9–12, it will be seen that the cap 22 includes an elongated base 27 terminating in a pair of transversely extending end members 28 and which confine the ends of the blades 23 disposed in the razor head in final assembly. The stakes 26 are longitudinally spaced along the base 27 and project downwardly, as illustrated in FIGS. 10 and 11, for reception in corresponding openings in the blades 23 and in the platform 20. As illustrated in FIG. 15, the stakes are splayed to lock the platform blades and cap in assembly. In accordance with the present invention, the upper surface of the cap 22 is recessed at 30. Preferably, the recess is generally rectangular in nature, extending the full length of base 27 between end members 28. As best illustrated in FIGS. 2 and 15, a lubrication strip 32 is disposed in the recess 30. The lubrication strip may comprise a basic mixture of polyethylene oxide and polystyrene. The lubrication strip 32 is preferably adhesively bonded to the bottom surface of the recess 30.

Referring particularly to FIGS. 6–8 and 15, the shield 18, preferably formed of a transparent plastic material, is provided to overlie the razor blade head 12, including the lubrication strip 32. Preferably, the shield is generally channel-shaped in cross-section, as illustrated in FIGS. 4 and 15 and has a generally flat base portion 40 and depending side edges or flanges 42. Each of the flanges 42 has enlarged end leg portions 44 which carry inwardly directed lugs 46 at their lower ends. The lugs 46 cooperate with chamfered surfaces 48 (FIG. 4) on the platform 20 to releasably lock the shield in a centered position overlying the razor blade head 12.

It will be appreciated that the shield 18 overlies the razor head in a close-fitting relation and particularly closely overlies lubrication strip 32. In order to dry the lubrication strip and to thereby minimize the swelling or enlargement of the lubrication strip due to moisture absorption following shaving, the undersurface of the base 40 of the shield 18 is recessed at 48 to provide an enlarged distance between the undersurface of the shield and the lubrication strip 32. This affords a substantial air volume or space 50 (FIG. 15) in the area between the shield and the razor head to facilitate drying of the strip. Moreover, the reduced swelling or enlargement of the lubrication strip 32 caused by the enhanced drying action facilitates the application of the shield 18 to the razor head without interference.

Additionally, and to further facilitate the drying of the lubrication strip, one or more holes 52 are provided through the base 40 of the shield 18. This affords a substantial circulation of air into the space 50 between the base 40 of the shield 18 and the upper surface of the razor head, including the lubrication strip 32. The circulation of air into that space serves to dry out the lubrication strip 32 and hence reduce its tendency to swell or enlarge due to moisture absorption after shaving.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A razor comprising:

a handle;

an elongated razor head carried by said handle;

a razor blade carried by said head and having a longitudinally extending cutting edge;

an elongated lubrication strip on said razor head adjacent said cutting edge for lubricating the skin during shaving;

an elongated shield removably carried by said head for overlying said cutting edge and said lubrication strip when said razor is not in use;

means for releasably securing said shield and said head one to the other;

said shield being generally channel-shaped in cross-section transverse to the longitudinal extent of said shield and having an elongated base, a pair of depending flanges along opposite sides of said base and open opposite ends, said base lying in direct overlying opposition to and being spaced from said lubrication strip to define an air space between said strip and said base when said shield is secured to said razor head, said base having a recess formed along its underside defining at least in part said air space between said lubrication strip and said shield; and means for communicating air into said space into contact with said lubrication strip to facilitate drying of the lubrication strip after shaving and return of said shield to its secured position on said head, said communicating means including at least one aperture opening through said base and communicating with said air space.

2. A razor according to claim 1 including a plurality of apertures in said shield spaced one from the other longitudinally along said shield.

3. A razor according to claim 2 wherein said plurality of apertures open into said recess.

4. A razor according to claim 1 wherein said base includes a plurality of apertures therethrough spaced longitudinally one from the other for communicating air into said space.

5. A razor according to claim 4 wherein said flanges and opposite side edges of said head have means cooperable for releasably securing said shield on said head.

6. A razor according to claim 1 wherein said base includes a plurality of apertures opening into said recess and spaced longitudinally one from the other for communicating air into said space, said flanges and opposite side edges of said head having means cooperable for releasably securing said shield on said head, said base having a pair of end ribs for engaging said razor head to space said base from said lubrication strip.

* * * * *